US008152333B2

(12) United States Patent
Boyer

(10) Patent No.: US 8,152,333 B2
(45) Date of Patent: Apr. 10, 2012

(54) REFLECTOR

(75) Inventor: John D. Boyer, Lebanon, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 13/179,193

(22) Filed: Jul. 8, 2011

(65) Prior Publication Data

US 2011/0265540 A1 Nov. 3, 2011

Related U.S. Application Data

(63) Continuation of application No. 12/255,042, filed on Oct. 21, 2008.

(60) Provisional application No. 60/982,564, filed on Oct. 25, 2007.

(51) Int. Cl.
*F21V 7/00* (2006.01)

(52) U.S. Cl. ..... 362/247; 362/249.02; 362/346; 362/800

(58) Field of Classification Search ..... 362/247, 362/249.02, 249.06, 311.02, 346, 800
See application file for complete search history.

(56) References Cited

U.S. PATENT DOCUMENTS

| | | | |
|---|---|---|---|
| 4,254,453 | A | 3/1981 | Mouyard |
| 4,935,665 | A | 6/1990 | Murata |
| 6,318,886 | B1 | 11/2001 | Stopa |
| 6,346,771 | B1 | 2/2002 | Salam |
| 6,793,368 | B2 | 9/2004 | Ladstätter |
| 6,840,654 | B2 | 1/2005 | Guerrieri et al. |
| 6,957,904 | B2 | 10/2005 | Randall |
| 7,008,079 | B2 | 3/2006 | Smith |
| 7,095,334 | B2 | 8/2006 | Pederson |
| 2006/0158899 | A1 | 7/2006 | Ayabe et al. |
| 2006/0268556 | A1 | 11/2006 | Hsieh |

FOREIGN PATENT DOCUMENTS

| | | |
|---|---|---|
| CN | 2872073 | 2/2007 |
| CN | 2926800 | 7/2007 |
| WO | WO 0074974 | 12/2000 |
| WO | WO 0074975 | 12/2000 |
| WO | WO 03036161 | 5/2003 |

*Primary Examiner* — Jason Moon Han
(74) *Attorney, Agent, or Firm* — McDermott Will & Emery LLP

(57) ABSTRACT

A metallic reflector device having one or an array of individual reflector elements for positioning over a corresponding one or array of light sources, preferably comprising one or more light emitting diodes (LEDs). The metallic reflector device includes a planar base and a plurality of the reflector elements. The planar base has one or a plurality of apertures, each aperture having an edge that defines a proximal rim of the reflector element. Each reflector element includes an annular sidewall having an inner surface that extends from the proximal annular rim to a distal annular rim. The proximal annular rim defines a first opening through which direct and reflected light from a light source is emitted. The distal annular rim defines a second opening through which the light source is disposed. The inner surface of the annular sidewall is formed from the material of the planar sheet by mechanically deforming the planar sheet, such as by stamping or drawing.

10 Claims, 11 Drawing Sheets

REFLECTOR

RELATED APPLICATIONS

This application is a divisional continuation application of U.S. patent application Ser. No. 12/255,042 filed Oct. 21, 2008, which claims priority to Provisional Application No. 60/982,564 filed Oct. 25, 2007.

FIELD OF THE INVENTION

The present disclosure relates generally to a lighting apparatus and, more particularly, to a reflector capable of distributing light from one or more light sources. The reflector is particularly useful for distributing light emitted from one or more light emitting diodes (LEDs), as described herein, but is directed to reflectors capable of distributing light generated by any type of light source. A method of manufacturing the reflector is also disclosed.

BACKGROUND OF THE INVENTION

As in the quality and energy efficiency of light sources such as LEDs have improved, production costs have gone down. LEDs and other types of light sources are becoming commonly used in area lighting applications.

LEDs generally emit light in a lambertian pattern. To direct the light from an LED in a pre-determined direction, it is a usual practice to capture at least low angle light from the LED with an optic, such as a refracting element or a reflector directing this light in a predetermined direction and pattern. Refracting optics in the form of lenses are commonly used to control and direct light from LEDs. A common practice is to support the lens using the body of the LED device or the printed circuit board (PCB) on which the LED device is mounted, using support legs or other means. Each optical lens is usually affixed separately to the LED device or to the PCB, and in an irreversible manner, such that removal of an improperly installed lens to a light board is time consuming and can result in breaking the legs of the support means when removing it from the light board.

LED reflectors are typically positioned about the base end of the LED, and generally reflect light emitted from the LED only at lower emission angles. Reflectors generally do not reflect light emitted from the LED at high emission angles (that is, low angles relative to nadir), as can and do refractor lenses. In many LED lighting applications, there is no or less need to control the light emitted at high emission angles proximate nadir, wherein reflectors are well suited.

LEDs are finding increased use in a wide variety of lighting, including parking and street lighting, outdoor billboards and signage, indicator and safety lighting, and work and specific area lighting. The positioning, shaping, and orientation of LEDs used in such lighting can vary widely depending upon the type of service and the specific lighting needs of a project.

Reflectors for individual light sources, such as LEDs have in the past been constructed of plastic according to conventional plastic molding techniques. As is well known, the individual part molds used to form the specific molded part in plastic molding machines have a high initial or up-front capital cost, and do not lend themselves to minor changes in the orientation, size or shape of features in the molded part. Each time a part of a different size, orientation, or shape is needed, a new mold is required, with its associated high initial capital cost. To provide a reflective finish to the reflecting surface, the molded reflector was typically coated with a highly reflective metallized material, such as aluminum.

There remains a need to provide improved and effective means for incorporating light sources into lighting apparati and luminaries, and in particular, for forming highly reflective surfaces for reflecting low angle light from LEDs and other light sources.

SUMMARY OF THE INVENTION

The present invention relates to a metallic reflector device having one or more individual reflector elements, each for positioning over a corresponding light source and is particularly suitable for use with LEDs. In one embodiment, the metallic reflector device includes a planar base and a plurality of the reflector elements. Each reflector element defines an aperture having an edge that defines a proximal rim of the reflector element and an annular sidewall having an inner surface that extends from the proximal annular rim to a distal annular rim. The proximal annular rim defines a first opening through which direct and reflected light from a light source element is emitted. The distal annular rim defines a second opening through which the light source is disposed.

The invention also relates to a metallic reflector device for positioning over a corresponding at least one light source including: a) a planar reflective base having at least a first opening defined by annular rim, and b) at least one individual reflector element formed into the base, including an annular conical sidewall having an inner reflective surface, which extends from the annular rim of the planar base to a distal annular rim that defines a second opening that can accommodate the light source.

In one embodiment the metallic reflector device is made of a sheet of aluminum. The sheet of aluminum can have a highly reflective surface that is preserved during the forming of the reflector elements into the sheet, to provide the reflective inner surface of the reflector elements. Alternatively, the inner surface of the reflector element, and the reflective surface of the sheet can be provided with the highly reflective surface after formation, such as by metallizing, to provide high reflectance.

The planar base typically has opposed side edges and opposed end edges, and can optionally have a flange extending from a side or end edge thereof. The flange extends at an angle, including normal, from the planar base. Typically the flanges are formed integrally with the planar base as a unit, such as by folding a sheet member along lines to form the planar base and the flanges. The flange is typically used for positioning and securing the metallic reflector device into position within the housing of a luminaire.

Another embodiment includes a light source assembly comprising a plurality of light sources arranged in an array, and a metallized reflector device having a complementary array of reflector elements, each reflector element disposed over one of the light sources of the array. Also disclosed is the use of the metallic reflector device in luminaries and lighting devices to reflect light emitted from light sources.

Also disclosed is a method of making a metallic reflector device having at least one reflector element having, in one embodiment, an annular conical sidewall for positioning over at least one corresponding light source, including the steps of: a) providing a planar sheet having at least one first opening within the material of the planar sheet, and b) drawing an annular pattern of the material surrounding the at least one first opening toward a direction along an axial centerline through the at least one first opening, thereby forming a depression from the material of the planar sheet to form the reflector element.

The ornamental shape and design of various preferred configurations of metallic reflector devices and luminaries including the metallic reflector device, as shown in the figures, is also disclosed.

DETAILED DESCRIPTION OF THE INVENTION

As used herein, the term "array" means the positioning of at least two individual light sources, but including any number of light sources, arranged in a linear, curvilinear or matrix pattern, including a row, column, or rows and columns, circular patterns, and others. The spacing between the light sources in the array can be the same or different.

Figure 1:
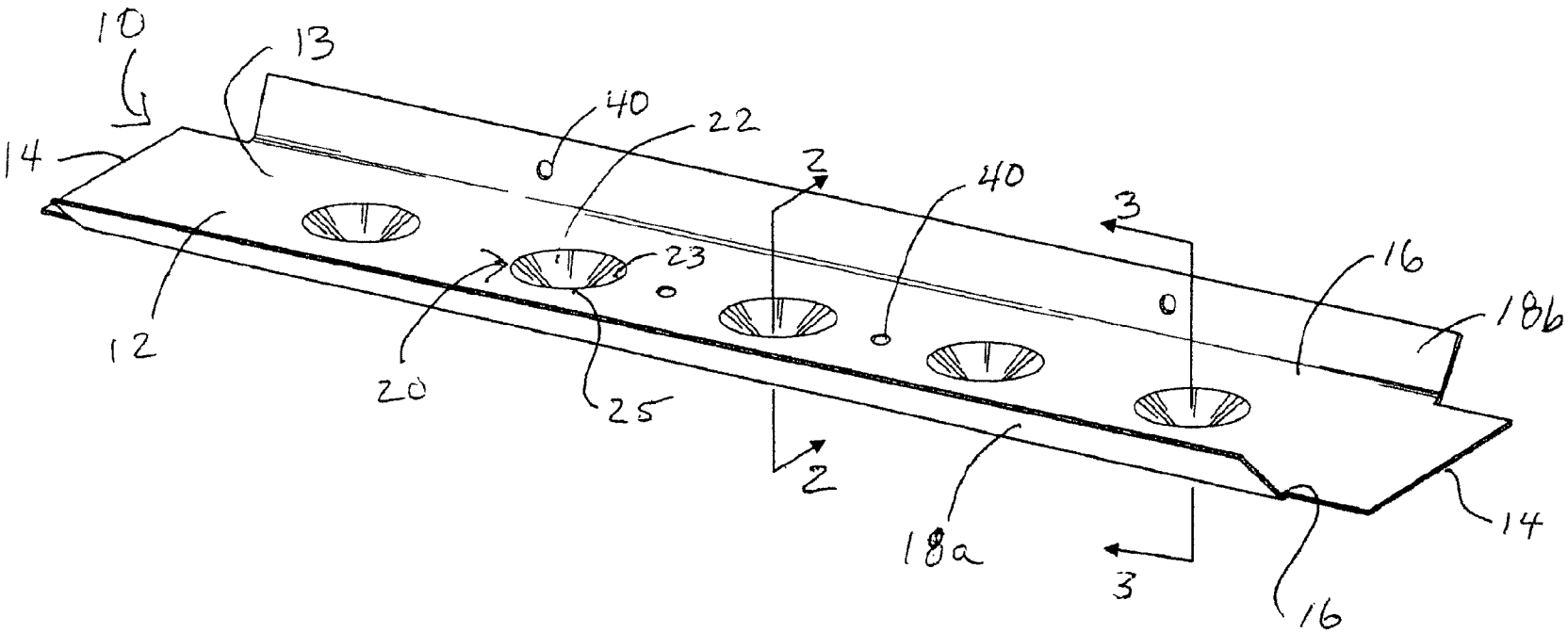
FIG. 1 shows a perspective view of a metallic reflector device including a planar base and an array of reflector elements.
Figure 2:
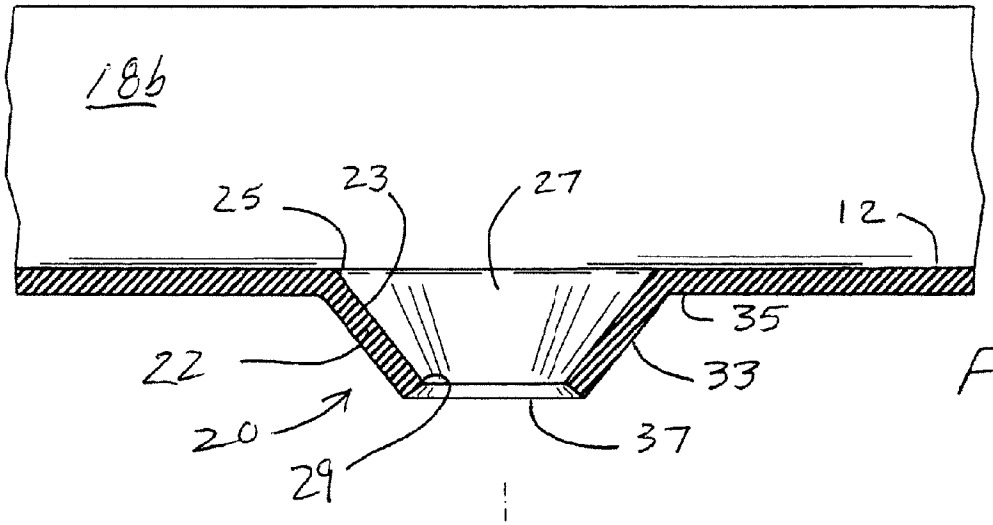
FIG. 2 shows a longitudinal cross sectional view of the metallic reflector device taken through line 2-2 of FIG. 1.
Figure 3:
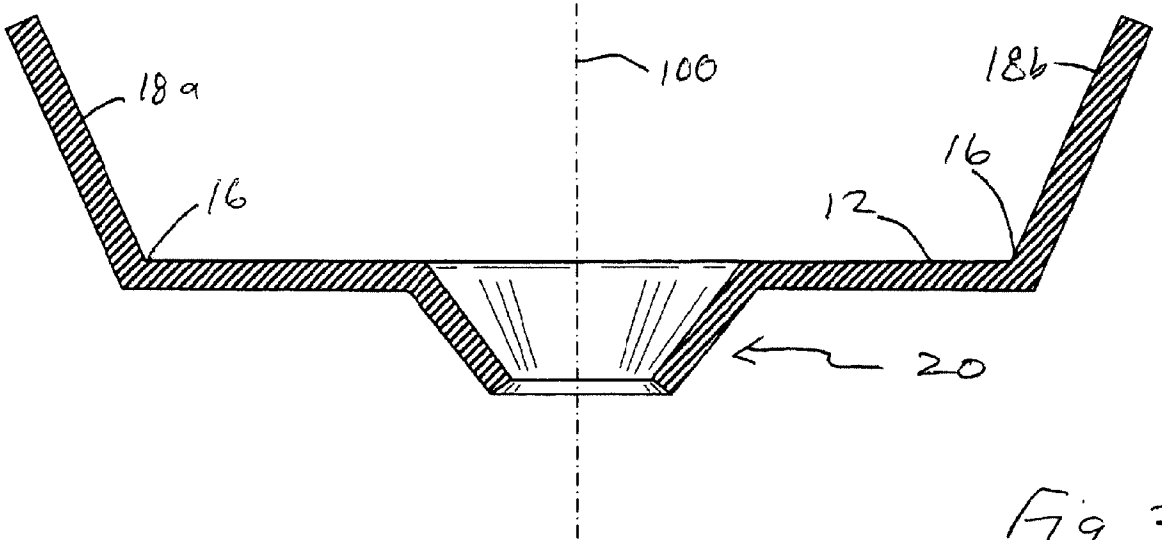
FIG. 3 shows a lateral cross sectional view of the metallic reflector device taken through line 3-3 of FIG. 1.

FIGS. 1-3 show a first embodiment of the metallic reflector device 10, having an elongated, rectangular planar base 12 have opposed first and second ends 14, and opposed first and second side edges 16. A pair of oppositely disposed flanges 18*a* and 18*b* extend from the respective first and second side edges 16, and are shown tilted outwardly at an angle, though they can be perpendicular or substantially co-planar with the planar base. A flange 18 can extend from either of the side edges 16, and from either or both ends 14. The flange 18 facilitates positioning and securing the metallic reflector element to a housing or other structure in a luminaire, or for securing another element of the luminaire to the metallic reflector device, including an additional adjacently disposed metallic reflector devices to form an array of reflector devices. Preferably, the flanges are formed integrally with the base as a unit from single sheet of metal, such as by folding a planar member along lines to form the base and the flanges.

The device 10 also includes at least one, and, in the depicted first embodiment, a plurality of, reflector elements 20. In the first embodiment, each reflector element 20 defines a dimple in the planar base 12, having an annular sidewall 22 defining an opening 37 about the centerline 100 of the annular sidewall 22 at the apex of the dimple. The cross-section of the sidewall 22 need not be annular, other shapes are also contemplated. The sidewall 22 may be formed integrally from a portion of a planar sheet of metal, such as by deforming and stretching out of the plane into a conical shape, by means known in the art. The sidewall 22 extends from a proximal rim 25 of the planar base that defines a circular opening 27, to a distal rim 29 that defines the distal circular opening 37. The sidewall 22 has an inner, reflector surface 23 that is conical in shape and typically circular in plan view and symmetrical, with centerline 100 passing axially through the reflector element. The sidewall 22 has a back-side or reserve surface 33.

The planar base 12 has a first surface 13 that is reflective, and a reverse surface that may, although need not be, reflective. The sheet metal from which the metallic reflector device is made is preferably aluminum, though other metals and alloys can be used, and has a sheet thickness of about 5 mil (0.13 mm) to about 50 mil (1.3 mm), more typically about 20 mil (0.5 mm) to about 30 mil (0.8 mm). The reflective surface 13 of the metallic sheet is typically of high reflectance, and in one embodiment, the surface is Miro-4 finish (about 95% reflectance).

In one embodiment, the reflector was formed of Specular Anodized Aluminum (e.g. Miro Press) having a thickness of 0.028 inches and provided with a Specular surface treatment having a reflectance value of 95%. The reflectors comprise a proximal rim having a diameter of 0.719 inches and a distal rim having a diameter of 0.313 inches spaced 0.188 inches from the proximal rim. The reflector wall is a straight annular wall extending at an angle of 47 degrees from parallel with the centerline of the proximal and distal rim. The reflector was placed over a Nichia NS6W-083 series LED such that the distal rim 39 circumscribed the LED, or at least the light emitting portion thereof. The distal rim 39 was brought into contact with the PCB in order to reflect all light emitted from the LED at an angle of greater than 47 degrees from parallel with the centerline of the reflector 100.

In the first, and all other, embodiments, the inner surface of the annular sidewall can be formed in a variety of manners to provide a cross sectional shape that reflects the light emitted from the light source in a radiation pattern, preferably a radiation pattern that is pre-selected to cooperate with the unreflected light emitted at high emission angles proximate nadir to emit an overall pre-selected radiation pattern. The cross sectional shape of the inner surface can be tapered inwardly from the distal annular rim to the proximal annular rim, and can be linear or curvilinear, including elliptical, parabolic, and other curved shapes.

The distal annular rim that defines opening 37 is typically formed in the planar sheet prior to forming the annular sidewall, although it can also be formed (that is, cut from the displaced, inboard planar sheet material) after or simultaneously with forming the annular sidewall. Conventional processes and apparatus for forming openings 37 into sheet metal are known. The handling of sheet metal and the forming of holes and opening is selected shapes, sizes and patterns can be accomplished using a CNC turret apparatus, among others, such as manufactured by Amada America, Inc.

The inner surface of the annular sidewall 22 may be formed from the material of the planar sheet by mechanically deforming the planar sheet, such as by standard stamping techniques as known in the art. Conventional means and apparatus for forming dimples into sheet metal are known. The drawing of the sheet metal into the reflector element can be accomplished with a forming punch and die, typically involving securing the planar sheet at the desired location of the distal annular rim, and applying mechanical force normal to the planar sheet material inboard of the distal annular rim, thereby displacing such inboard planar sheet material out of the plane of the planar sheet into the annular sidewall.

Figures 4, 5A, 5B:
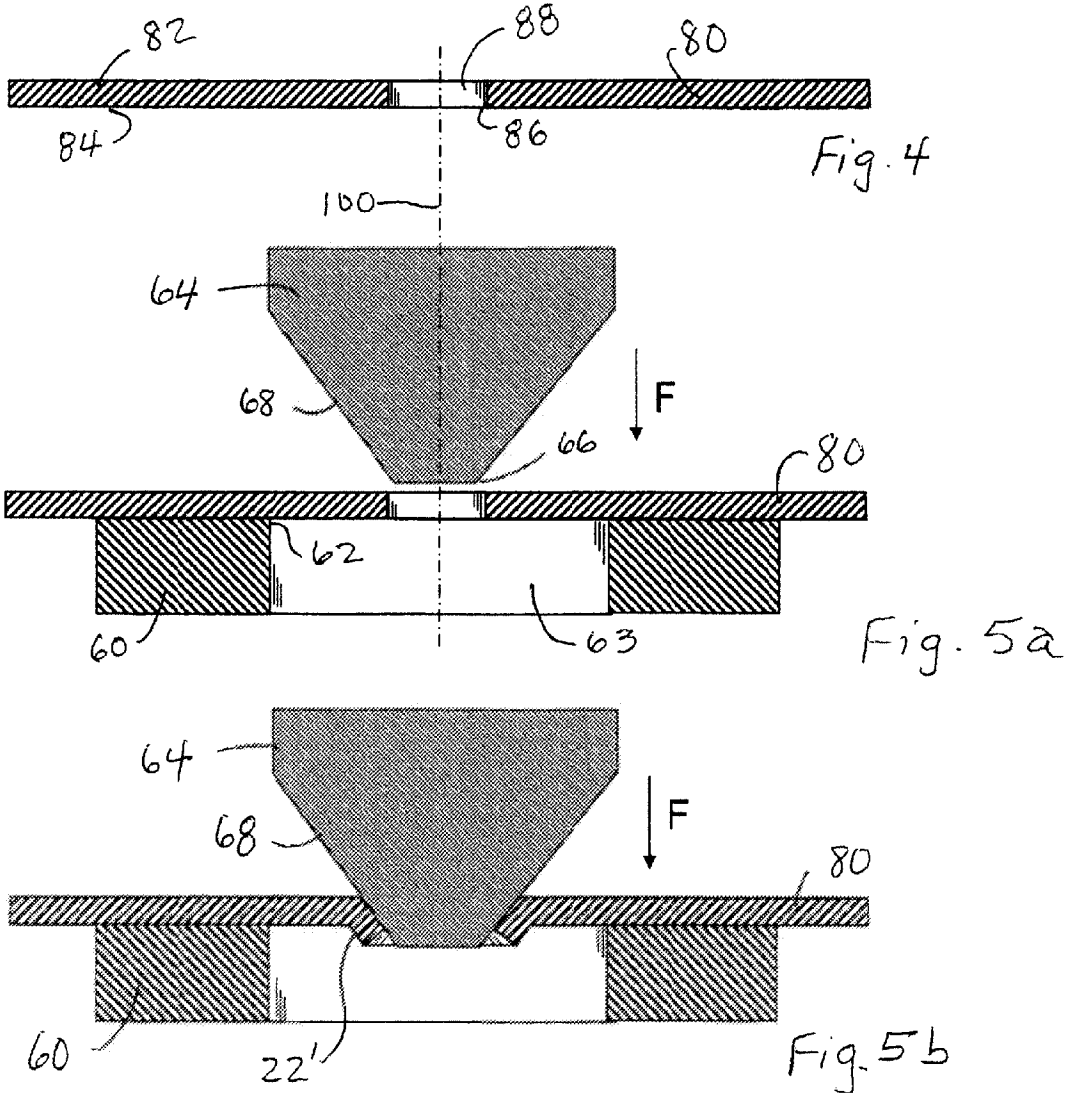
FIG. 4 shows a cross sectional view of a portion of a planar metallic sheet having an aperture that can be formed into a reflector element.
FIGS. 5*a*, 5*b* and 5*c* show a series of process steps for forming a reflector element into the planar metallic sheet of FIG. 1.
Figure 5C:
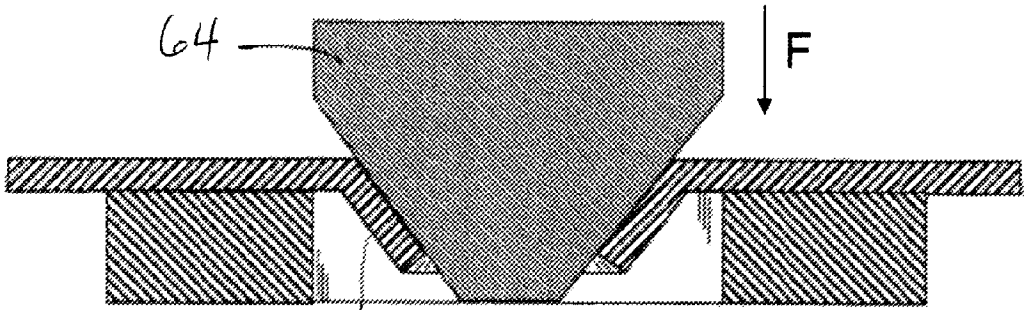

FIGS. 4 and 5*a*-5*c* illustrate one method for forming the reflector element, as will be understood by those of ordinary skill in the art. A planar sheet of metal 80 is provided with a preformed annular opening 88 that is defined by circular rim 86. The sheet of metal 80 typically has a reflective surface 82 and a reverse surface 84. As seen in FIG. 5*a*, a die, such as an annular support ring 60, is placed against the reverse surface 84 of the sheet 80. The support ring has an annular rim 62 that defines an aperture 63 that is approximately centered around and aligned with the centerline 100 of the annular opening 88. The size of the annular aperture 63 of the support ring 60 is selected to define the size of the reflector opening 27 formed in the planar base. The die anchors and supports the sheet metal as the circular portion of the sheet registered over the aperture 63 is drawn by a punch 64. In the depicted embodiment, the punch 64 has a frustum shape that is circular and symmetrical, and defines the resulting shape of the reflector sidewall. The distal end 66 of the punch sidewall 68 is typically smaller in size than the opening 88 in the metal sheet 80. The axial centerline of the punch 64 is aligned along the centerline 100 of the opening 88. In FIGS. 5*b* and 5*c*, the punch 64 is forced downward into the reflective surface 82 of the metal sheet 80, engaging first the conical sidewall 68 of the punch 64 against the annular rim 86 of the sheet metal. As the punch 64 is forced downward, the annular sidewall 68 of the punch 64 engages more of the planar sheet material surrounding the opening 88, and draws the material into intermediate sidewalls 22' and 22". The drawing modifies the orientation of the sheet material, from planar to angular, and is also believed to effect a stretching of the sheet material in the direction of the distal rim 29. Optionally, the deformation of the sheet metal is accomplished by force, as described above, with the assistance of heat. Other techniques used in drawing and forming sheet metal can be used, including annealing. Forming a sheet of aluminum can cause the aluminum sheet to harden, which can cause cracking and fracture. Periodically annealing the worked aluminum (heating it to a certain elevated temperature) causes the formed aluminum sheet to release its tension so that it can be further molded and formed. Annealing and its procedure are well known to persons of skill in this art.

The depicted resulting reflector element 20 has conical sidewall 22 with a substantially linear shape in cross section although variations therefrom are contemplated. Alternative embodiments of the reflector elements can provide sidewalls in cross section that are curvilinear, and typically concave relative to the centerline 100. The curvilinear sidewall shape can be parabolic, elliptical, or other shape. The shape of the sidewall affects the pattern of emitted light from the light source that strikes the sidewall. The formation of a sidewall of a different shape or angle can be accomplished by modifying the cross sectional shape of the punch 64. In the illustrated embodiment, the angle θ of the sidewall surface 23, from centerline 100, is about 40° to 50°, such as about 45°.

Figure 5D:
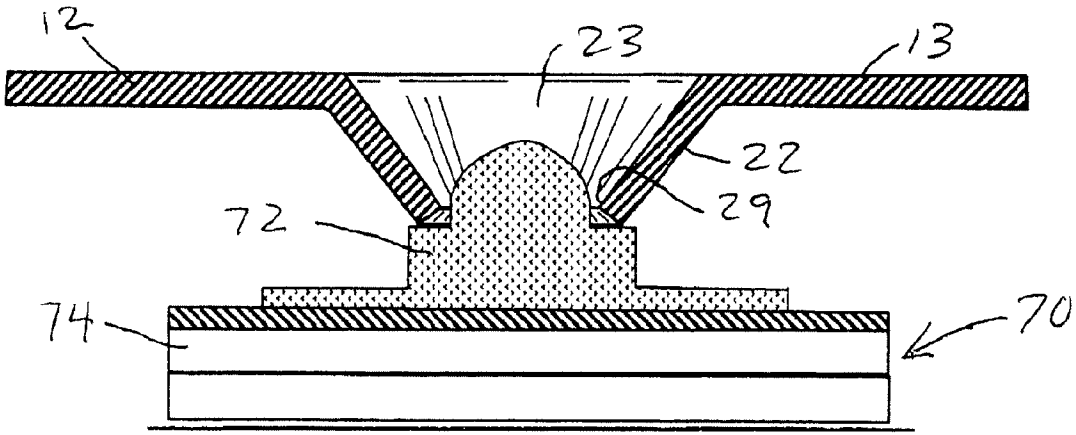
FIG. 5*d* shows the reflector element after the forming steps of FIGS. 5*a*, 5*b* and 5*c*, disposed over a light source.
Figure 9:
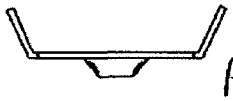
FIG. 9 shows a right side elevation view of the metallic reflector device of FIG. 1; the left side elevation view is the same.
Figure 6:
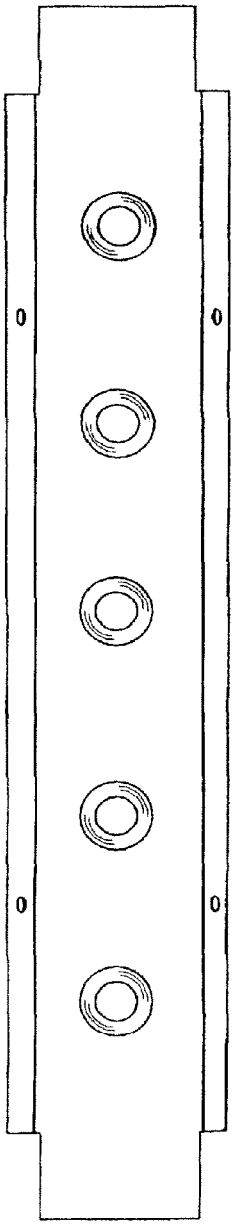
FIG. 6 shows a top plan view of the metallic reflector device of FIG. 1.
Figure 7:
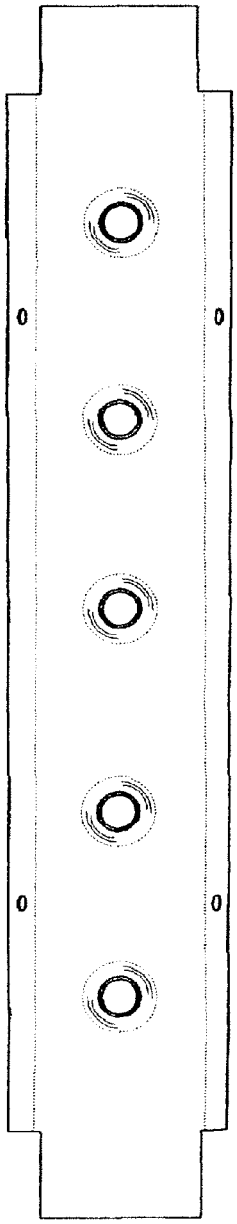
FIG. 7 shows a bottom plan view of the metallic reflector device of FIG. 1.
Figure 8:
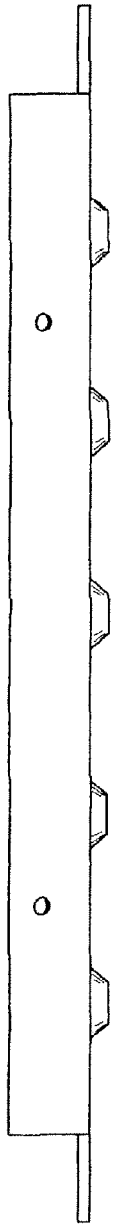
FIG. 8 shows a front elevation view of the metallic reflector device of FIG. 1; the back elevation view is identical.

FIG. 5*d* shows the resulting reflector element formed in the metallic reflector device positioned over a light source, which may be an LED on a PCB which provides a support substrate for the LED and the power and control wiring and circuitry for powering and controlling the LED. In one embodiment, the PCB is an FR4 board with a metal core sheet or strip that is laminated to the FR4 board with thermally-conductive adhesive or epoxy. FR4, an abbreviation for Flame Resistant 4, is a composite of a resin epoxy reinforced with woven fiberglass mat. The metal core aids in heat dissipation from the LED. The LED itself typically has a specialized slug integrated with the LED casing to conduct heat produced by the interior die away from the LED, as is well known in the art. The FR4 board typically has a top layer of copper that can include a network of flattened copper connectors or traces for making electrical connections between component and for conducting heat away from the LED.

When light source 72 is comprised of an LED, the light emitted from the LED 72 at high angles (that is, as small angles from nadir) pass directly though the opening 23 in the planar base 12. Most of the remaining light emitted at low angles reflects off of the inner reflective surface 23 of the reflector element 22 and out through the same opening 23. Selection of the angle and shape of the conical sidewall surface 23 can direct the reflected light to a pre-selected pattern. As depicted in FIG. 5*d*, the distal rim 39 circumscribes the LED, or at least the light emitting portion thereof. The distal rim 39 may, but need not, be in contact with the PCB in order to reflect all light emitted from the LED at an angle of greater than θ degrees from parallel with the centerline of the reflector 100 where θ is the angle the annular wall 22 makes with the centerline 100. The reflector is particularly useful with LEDs emitting light in a Lambertian pattern, but finds use with LEDs, or other light sources, with different light distribution patterns. The usefulness of the reflector 20 is not limited to applications with a light source or LED of the particular shape depicted in FIG. 5*d*. In an alternative embodiment, the reflector 20 may be inverted so that the light source is inserted into the proximal rim 25 rather than the distal rim 29.

The metallic reflector device 10 can be positioned over and secured to the light source or PCB by well known means, including screws or other hardware passing through a securement opening 40 in the planar base 12 and into or through the PCB, or by adhesive, and preferably thermally-conductive adhesive, clasps, brackets, etc. The metallic reflector device 10 can be placed directly against the light source 72, or can be positioned off-set with a suitable spacer or gasket.

FIGS. 6, 7 8 and 9 show the top, bottom, front and back, and right and left sides of the metallic reflector device 10 of FIG. 1.

Figure 11:
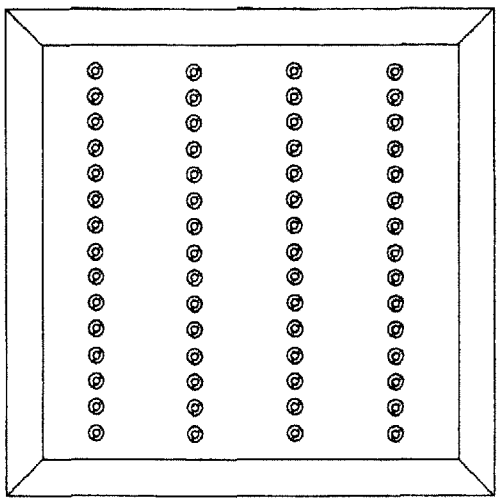
FIG. 11 shows a bottom view of the luminaire of FIG. 10.
Figure 10:
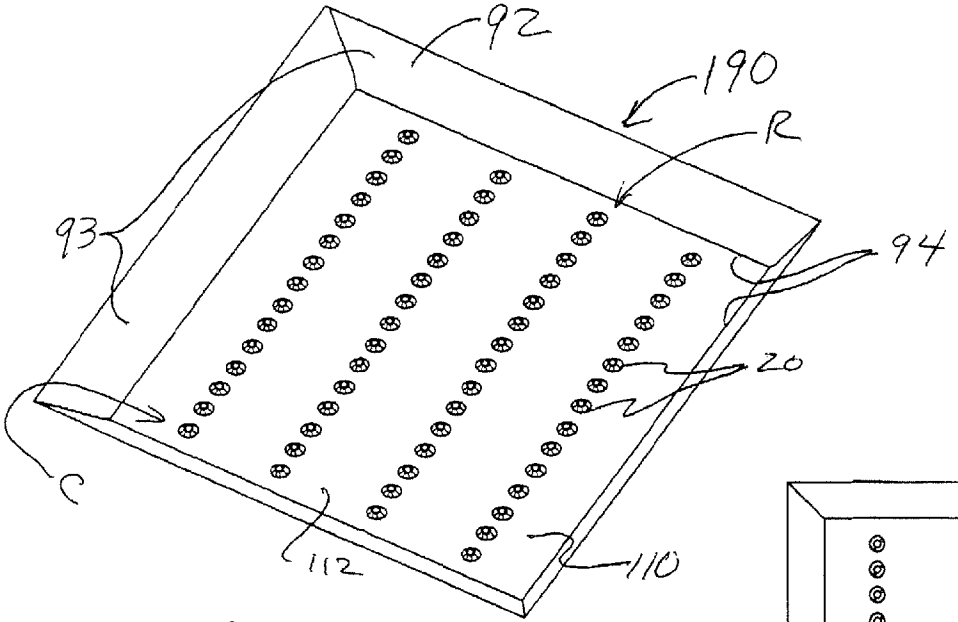
FIG. 10 shows a perspective view of a luminaire including a second embodiment of a metallic reflector device associated with a plurality of light sources.
Figure 12:
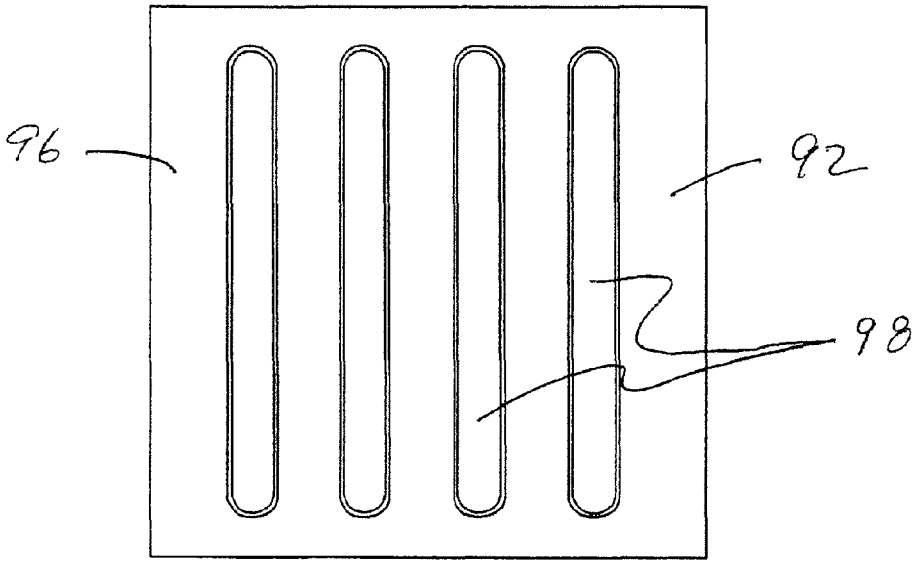
FIG. 12 shows a top view of the luminaire of FIG. 10.
Figure 13B:
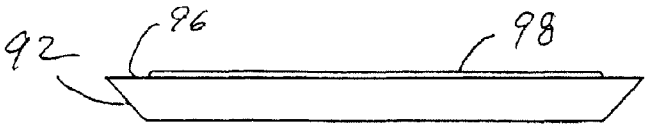
FIG. 13*b* shows a right side view of the luminaire of FIG. 11; the left side view is the same.
Figure 13A:
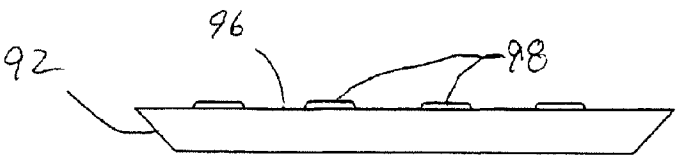
FIG. 13*a* shows a front view of the luminaire of FIG. 11; the back view is the same.

FIG. 10 shows an embodiment of a luminaire 190 that includes a second embodiment of a metallic reflector device 110. The luminaire includes a housing 92 consisting of four side member 93 arranged end to end in a rectilinear frame. Each side member 93 has an inner edge 94 that define an opening in the housing 92. Positioned and secured by well known means within the housing 92 is the metallic reflector device 110, which includes a plurality of rows R and columns C of reflector elements 20 positioned in a matrix on the planar reflective base 112. FIG. 11 shows a bottom view, while FIGS. 12, 13*a* and 13*b* shows respective top, front and back, and right and left side views. The top view in FIG. 12 shows a plurality of elongated embossments projecting out from the base 96 of the housing. The embossments 98 provide a recess within the inner surface of the base 96 within which portions of a light source, such as the LED substrate (the PCB), can be affixed, as described in U.S. Provisional Patent Application 60/953,009, and in U.S. Non-Provisional patent application Ser. No. 12/183,403 claiming priority therefrom, both of which are incorporated herein by reference.

Figure 14:
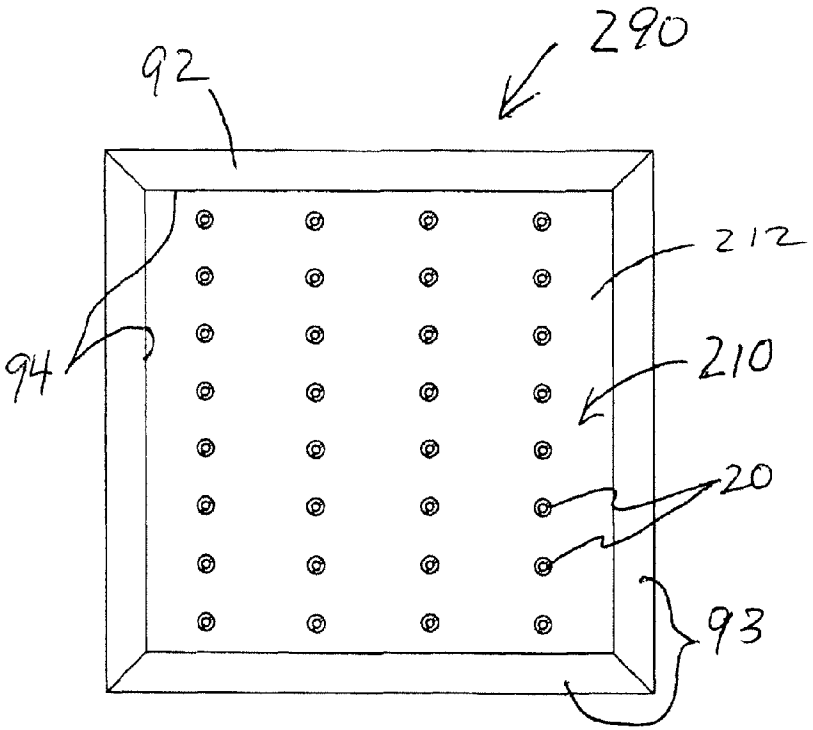
FIG. 14 shows the bottom view of the luminaire of FIG. 10 that includes a third embodiment of a metallic reflector device.

FIG. 14 shows a front view of a luminaire 290 similar to that shown in FIG. 10, which includes a housing 92 and a third embodiment of a metallic reflector device 210, having an alternative pattern of reflector elements 20 arranged on the reflective planar base 212.

Figure 15:
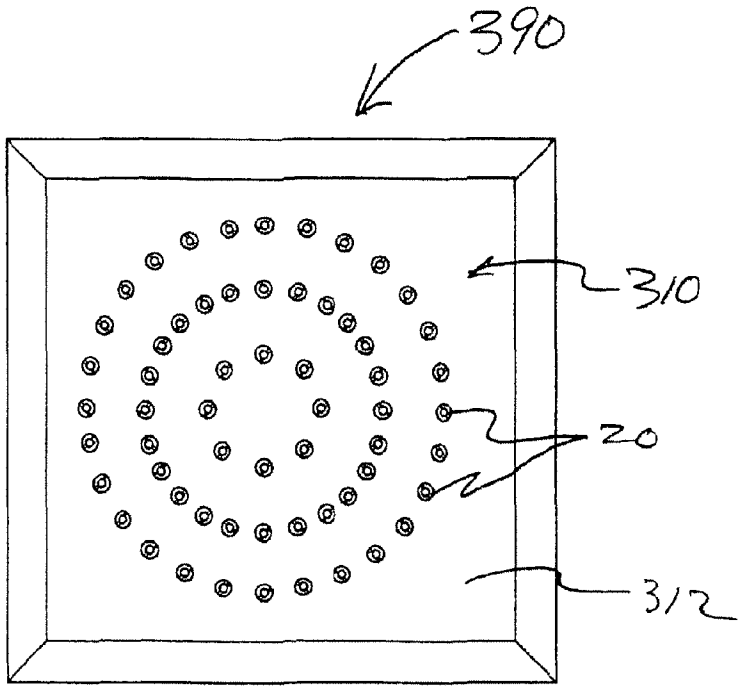
FIG. 15 shows the bottom view of the luminaire of FIG. 10 that includes a fourth embodiment of a metallic reflector device.

FIG. 15 shows a front view of the luminaire 390 similar to that shown in FIG. 10, which includes a fourth embodiment of a metallic reflector device 310, having an alternative pattern of reflector elements 20 arranged on the reflective planar base 312.

Figure 16:
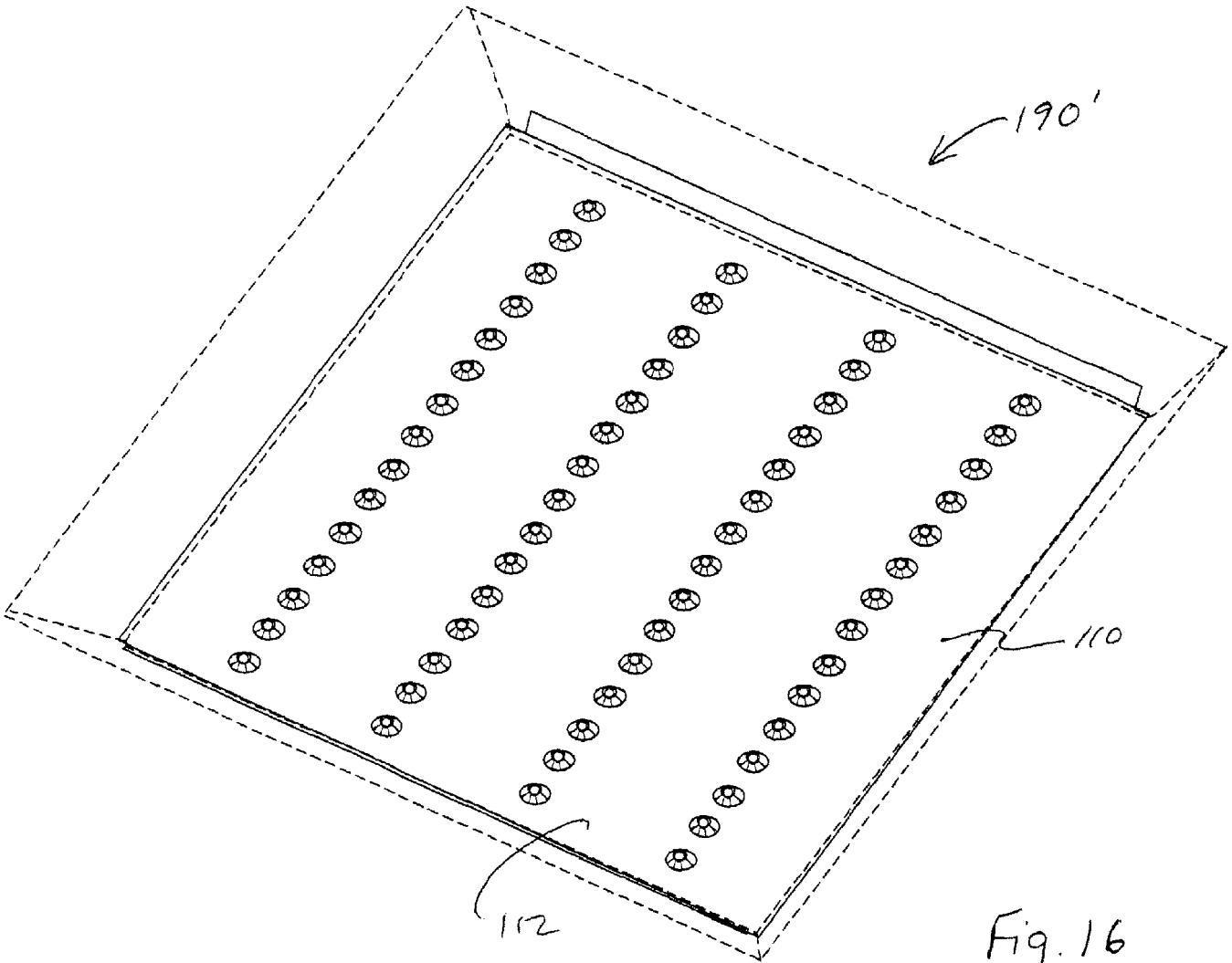
FIG. 16 shows a perspective view of a second luminaire that includes the second embodiment of a metallic reflector device associated with a plurality of light sources.
Figure 18:
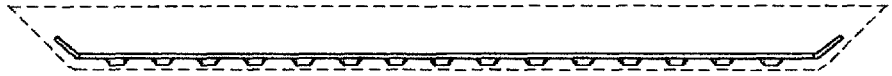
FIG. 18 shows a front view of the second luminaire of FIG. 16; the back view is the same.
Figure 19:
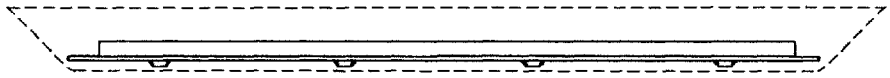
FIG. 19 shows a right side view of the luminaire of FIG. 16; the left side view is the same.
Figure 17:
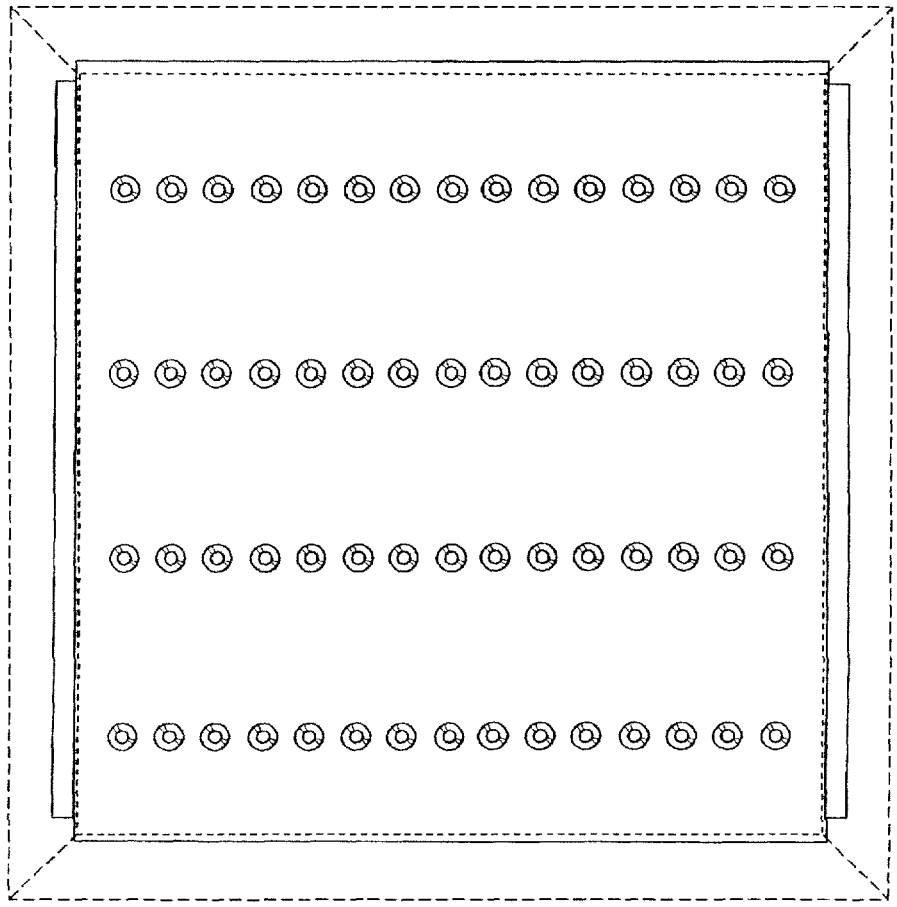
FIG. 17 shows a bottom view of the second luminaire of FIG. 16; the top view is the same.

FIG. 16 shows an embodiment of a second luminaire 190' that includes the second embodiment of a metallic reflector device 110. The second luminaire 190' is similar to the luminaire 190, except that the purposes of the ornamental shape and design of the luminaire, the shape of the housing is shown in broken lines, which are for illustrative purposes only and form no part of a claimed design to such embodiment. FIGS. 17, 18, and 19 are respective bottom, front and back, and right side and left side views of the second luminaire 190', wherein the broken lines are for illustrative purposes only and form no part of a claimed design to such embodiment.

Figure 21:
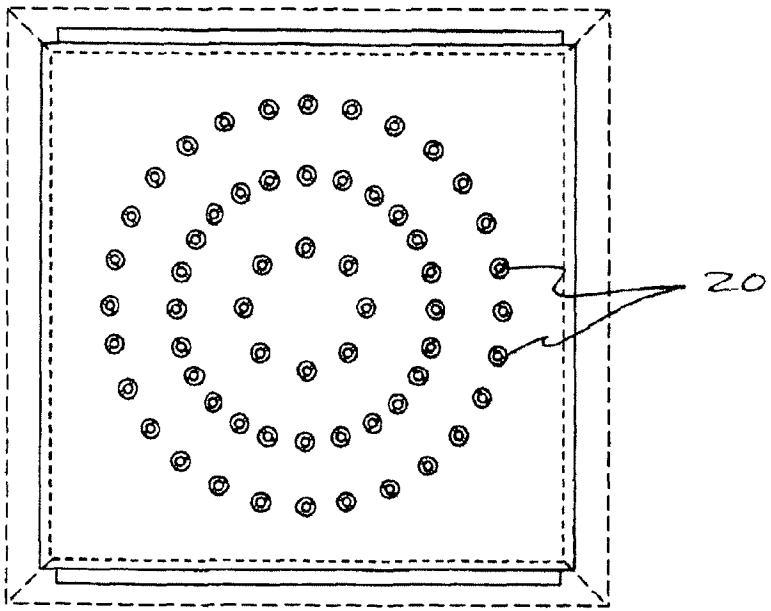
FIG. 21 shows a bottom view of the second luminaire that includes the fourth embodiment of the metallic reflector device shown in FIG. 15.
Figure 20:
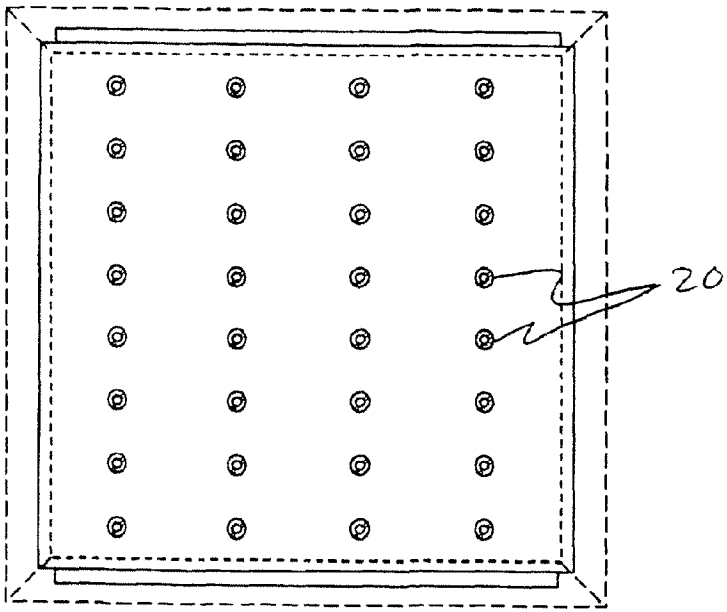
FIG. 20 shows a bottom view of the second luminaire that includes the third embodiment of the metallic reflector device shown in FIG. 14.

FIGS. 20 and 21 are bottom views of alternative luminaries, respectively, showing an alternative pattern of reflector elements 20 arranged on the reflective planar bases, wherein the broken lines are for illustrative purposes only and form no part of a claimed design to such embodiments.

The metallic reflector device and light source assembly can be incorporated into a variety of luminaire, including but not limited to the luminaire described in U.S. Provisional Patent Applications No. 60/982,240 and No. 60/980,562, and also in U.S. Non-Provisional patent applications Ser. Nos. 12/254,107 and 12/166,536 claiming priority therefrom respectively, the disclosures of which are incorporated herein by reference.

While the invention has been disclosed by reference to the details of preferred embodiments of the invention, it is to be understood that the disclosure is intended in an illustrative rather than in a limiting sense, as it is contemplated that modifications will be readily apparent to those skilled in the art, within the spirit of the invention and the scope of the appended claims.

I claim:

1. A method of making a metallic reflector device having a base having one or more winged flanges extending therefrom, a plurality of proximate annular rims, and a plurality of reflector elements extending from the plurality of proximate annular rims to a plurality of distal annular rims, each defining an opening capable of accommodating a light source, one or more of the reflector elements comprising an annular sidewall extending from the proximate annular rim to the distal annular rim, the method of making comprising the steps of:

a) providing a sheet defining the base;

b) defining the openings; and c) drawing an annular pattern in a material of the sheet surrounding each of the openings in a direction along an axial centerline through each of the openings, thereby forming (i) the proximate annular rims, and (ii) the annular sidewalls defining depressions in the material of the sheet to form the plurality of reflector elements; and d) forming the one or more winged flanges along a longitudinal direction of the base opposite to the depressions.

2. The method of claim 1 wherein the depression is conical.

3. The method of claim 1 wherein the distal annular rim has a circular cross section.

4. The method of claim 1 wherein the angle of the annular sidewall between the centerline and the sidewall is about 40°-50°.

5. The method of claim 1 wherein the sheet is planar.

6. The method of claim 5 wherein the planar sheet is aluminum sheet metal.

7. The method of claim 1 wherein the step of drawing the annular pattern comprises drawing the proximate annular rim to have a circular cross section.

8. The method of claim 1 wherein the step of drawing an annular pattern comprises drawing the annular pattern to have a straight sidewall.

9. The method of claim 1 wherein the step of drawing an annular pattern comprises drawing the depression to be substantially conical using a support ring and punch.

10. The method of claim 1 further comprising the treating the material surrounding each of the openings with heat.

* * * * *